US010933466B2

(12) United States Patent
Bulgrin et al.

(10) Patent No.: US 10,933,466 B2
(45) Date of Patent: Mar. 2, 2021

(54) METHODS FOR FABRICATING CAST COMPONENTS WITH COOLING CHANNELS

(71) Applicant: Rolls-Royce Corporation, Indianapolis, IN (US)

(72) Inventors: Charles Alan Bulgrin, Plainfield, IN (US); Carl R. Russo, Clayton, IN (US); Matthew T. Kush, Martinsville, IN (US)

(73) Assignee: ROLLS-ROYCE CORPORATION, Indianapolis, IN (US)

( * ) Notice: Subject to any disclaimer, the term of this patent is extended or adjusted under 35 U.S.C. 154(b) by 310 days.

(21) Appl. No.: 15/595,028

(22) Filed: May 15, 2017

(65) Prior Publication Data

US 2017/0326635 A1 Nov. 16, 2017

Related U.S. Application Data

(60) Provisional application No. 62/336,856, filed on May 16, 2016.

(51) Int. Cl.
*B22D 25/02* (2006.01)
*B22D 27/04* (2006.01)
(Continued)

(52) U.S. Cl.
CPC ..... *B22D 25/02* (2013.01); *B22C 1/00* (2013.01); *B22C 7/00* (2013.01); *B22C 9/106* (2013.01);
(Continued)

(58) Field of Classification Search
CPC ..... B22D 25/02; B22D 27/04; B22D 27/045; B22D 29/002; B22C 1/00; B22C 7/00;
(Continued)

(56) References Cited

U.S. PATENT DOCUMENTS 4,989,664 A 2/1991 Roth
5,465,780 A * 11/1995 Muntner ..... B22C 9/04 164/369
(Continued)

FOREIGN PATENT DOCUMENTS

EP 0 539 317 A1 4/1993
EP 2 463 043 A1 6/2012
(Continued)

OTHER PUBLICATIONS

Extended European Search Report dated Oct. 19, 2017 for related European Patent Application No. 17168131.5.

*Primary Examiner* — Kevin P Kerns
*Assistant Examiner* — Steven S Ha
(74) *Attorney, Agent, or Firm* — Brinks Gilson & Lione

(57) ABSTRACT

A method for fabricating a cast component with a cooling channel is provided. The method includes forming a shell mold over a pattern-ceramic matrix composite (CMC) elongated core arrangement to define a cavity in the shell mold. The pattern-CMC elongated core arrangement includes a pattern-forming material with a CMC elongated core disposed therein. The pattern-forming material in the cavity is replaced with metal via a casting process to form the cast component with the CMC elongated core disposed therein defining the cooling channel. The CMC elongated core is removed from the cast component to open the cooling channel for fluid communication.

21 Claims, 5 Drawing Sheets

(51) Int. Cl.

| | |
|---|---|
| ***B22C 9/10*** | (2006.01) |
| ***B22C 1/00*** | (2006.01) |
| ***B22C 7/00*** | (2006.01) |
| ***B22C 9/24*** | (2006.01) |
| ***B22D 21/00*** | (2006.01) |
| ***B22D 29/00*** | (2006.01) |
| *F01D 9/02* | (2006.01) |
| *F01D 25/12* | (2006.01) |

(52) U.S. Cl.
CPC ..... *B22C 9/108* (2013.01); *B22C 9/24* (2013.01); *B22D 21/005* (2013.01); *B22D 27/04* (2013.01); *B22D 27/045* (2013.01); *B22D 29/002* (2013.01); *F01D 9/02* (2013.01); *F01D 25/12* (2013.01); *F05D 2230/211* (2013.01); *F05D 2300/10* (2013.01)

(58) Field of Classification Search
CPC ..... B22C 9/106; B22C 9/108; B22C 9/24; B22C 21/005; F01D 9/02; F01D 25/12; F05D 2230/211; F05D 2300/10
See application file for complete search history.

(56) References Cited

U.S. PATENT DOCUMENTS

| | | | | |
|---|---|---|---|---|
| 6,029,736 | A | 2/2000 | Naik et al. | |
| 2011/0315337 | A1* | 12/2011 | Piggush | B22C 9/103 164/23 |
| 2012/0186768 | A1* | 7/2012 | Sun | B22C 7/02 164/23 |
| 2012/0291983 | A1* | 11/2012 | Graham | B22C 9/04 164/516 |

FOREIGN PATENT DOCUMENTS

| | | | | |
|---|---|---|---|---|
| EP | 3 034 196 | A1 | 6/2016 | |
| WO | WO-2012118516 | A1 * | 9/2012 | C04B 35/565 |

* cited by examiner

METHODS FOR FABRICATING CAST COMPONENTS WITH COOLING CHANNELS

RELATED APPLICATIONS

The present patent document claims the benefit of priority under 35 U.S.C. § 119(e) to U.S. Provisional Patent Application Ser. No. 62/336,856, which was filed on May 16, 2016, and is hereby incorporated by reference in its entirety.

TECHNICAL FIELD

The present disclosure relates generally to cast components, and more particularly to methods for fabricating cast components with cooling channels, such as, for example, for a gas turbine engine or the like.

BACKGROUND

Component casting is used to produce a wide range of components and members. Essentially, the component is cast in a mold from a molten metal liquid and then allowed to cool to leave a solidified component. Some components, such as gas turbine engine components, are subject to mechanical stresses such as an aerodynamic load and further, are subjected to a thermal load. The metal materials forming the cast component are vulnerable to thermal and/or mechanical distress under excessive thermal loading. Therefore, cooling systems are desirable for excessive heat and/or to distribute heat evenly across the profile of the component, such as, for example, to maintain structural integrity in the vicinity of attachments between components where mechanical loading can be quite significant.

One approach is to form long, narrow cooling channels in the cast component during the casting process as part of a thermal management cooling system. Currently, long, narrow ceramic cores formed of silica or the like can be used to correspondingly form long, narrow cooling channels during molten metal casting. Unfortunately, such approaches can be problematic. For example, during the casting process, the long, narrow ceramic cores come into contact with molten metal and can become too weak and/or brittle, thereby becoming dimensionally unstable and/or resulting in fracturing. This is particularly problematic in single crystal metal casting, which is commonly used to form gas turbine engine components, because of the very high preheat temperatures of the mold required for single crystal casting of about equal to or greater than the melting point of the metal alloys being used to form the cast component. Accordingly, it is desirable to provide improved methods for fabricating cast components having cooling channels formed therein. Furthermore, other desirable features and characteristics of the present disclosure will become apparent from the subsequent detailed description and the appended claims, taken in conjunction with the accompanied drawings and this background.

BRIEF SUMMARY

Methods for fabricating cast components with cooling channels are provided herein. In accordance with an exemplary embodiment, a method for fabricating the cast component having a cooling channel formed therein includes forming a shell mold over a pattern-ceramic matrix composite (CMC) elongated core arrangement to define a cavity in the shell mold. The pattern-CMC elongated core arrangement includes a pattern-forming material with a CMC elongated core disposed therein. The pattern-forming material in the cavity is replaced with metal via a casting process to form the cast component with the CMC elongated core disposed therein defining the cooling channel. The CMC elongated core is removed from the cast component to open the cooling channel for fluid communication.

In accordance with another exemplary embodiment, a method for fabricating a cast component having a cooling channel formed therein is provided. The method includes disposing a ceramic matrix composite (CMC) elongated core in a pattern that comprises a pattern-forming material. The CMC elongated core includes a ceramic matrix reinforced with ceramic fibers. A shell mold is formed over the pattern-CMC elongated core arrangement to define a cavity in the shell mold. The pattern-forming material is removed from the shell mold while leaving the CMC elongated core disposed in the cavity. The cavity is filled with molten metal and the molten metal is solidified to form the cast component with the CMC elongated core disposed therein defining the cooling channel. The CMC elongated core is leached out or etched to open the cooling channel in the cast component for fluid communication.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Figure 1:
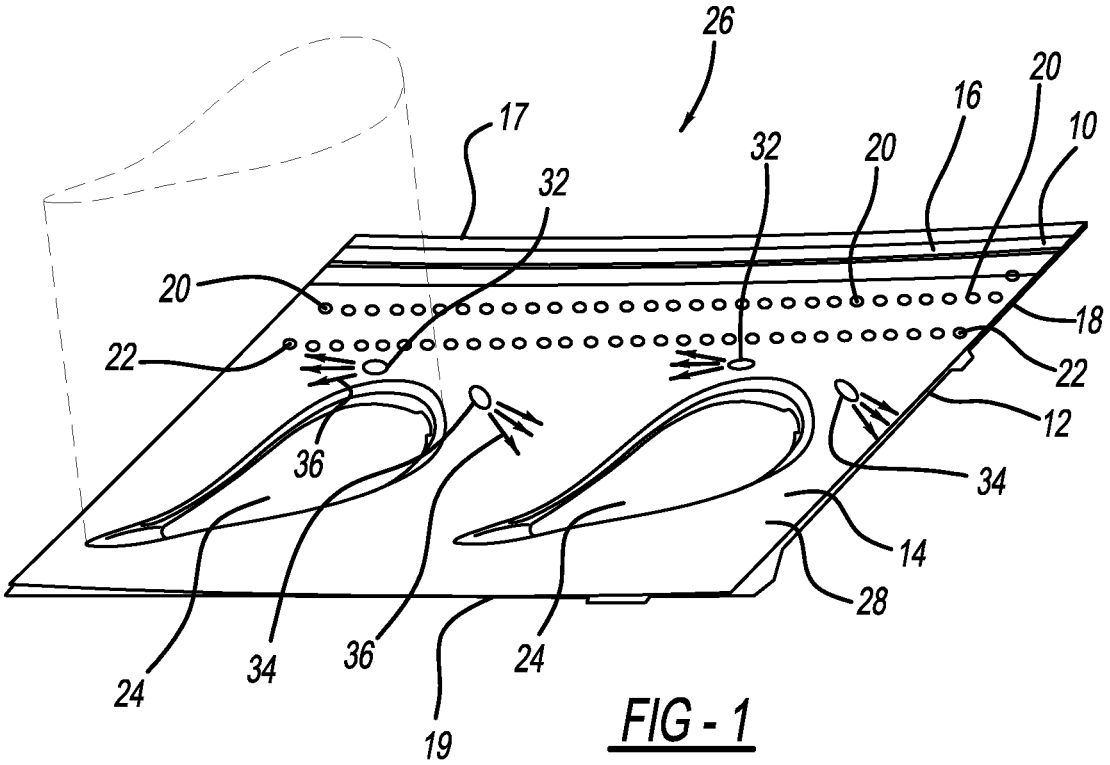
FIG. 1 is a perspective front view of a cast component in accordance with an exemplary embodiment.

The following detailed description is merely exemplary in nature and is not intended to limit the disclosure or the application and uses of the disclosure. Furthermore, there is no intention to be bound by any theory presented in the preceding background or the following detailed description.

Various embodiments contemplated herein relate to methods for fabricating cast components with cooling channels.

The exemplary embodiments taught herein arrange a ceramic matrix composite (CMC) elongated core in a pattern that comprises a pattern-forming material, such as, for example, wax or a plastic material. The CMC elongated core is configured as a long and narrow core structure that includes a ceramic matrix that is reinforced with ceramic fibers. A shell mold is formed over the pattern-CMC elongated core arrangement to define a cavity in the shell mold. In one example, the shell mold is formed using an investment casting process including dipping the pattern-CMC elongated core arrangement in a ceramic slurry. The ceramic slurry material is then dried to form a hardened shell mold. The pattern-forming material is removed from the shell mold, e.g., via melting out, washing out, and/or burning out the pattern-forming material, while leaving the CMC elongated core disposed in the cavity of the shell mold.

In an exemplary embodiment, the cavity of the shell mold is filled with molten metal and the molten metal is solidified to form the cast component with the CMC elongated core disposed therein defining a cooling channel. The process continues by leaching out or etching the CMC elongated core to open the cooling channel in the cast component for fluid communication.

It has been found that by using a CMC elongated core, which is reinforced with ceramic fibers, to form a cooling channel in the cast component during the casting process, the elongated core is sufficiently reinforced and dimensionally stable to ensure that the elongated core remains in a predetermined position in the shell mold even when exposed to relatively higher temperatures including coming into direct contact with molten metal, to thereby facilitate the formation of a relatively long and narrow cooling channel as part of a thermal management cooling system for the cast component, e.g., which allows cooling air or gases to pass through the component cooling channel to remove and/or redistribute heat.

Moreover, it is to be understood that the various embodiments disclosed herein can be used in combination with and/or allow for the use of other advanced and/or complex cooling systems for the respective component(s) and/or adjacent and/or cooperating component(s), for example in gas turbine engine applications. A non-limiting example of such an advanced and/or complex cooling system is Cast-Bond® technology (e.g., machining process to form a complexly cooled multi-walled component such as an airfoil or the like) disclosed at least in U.S. Patent Application No. 2014/0257551, which is commonly owned by the assignee of the present application and which is hereby incorporated by reference in its entirety for all purposes.

Figure 2:
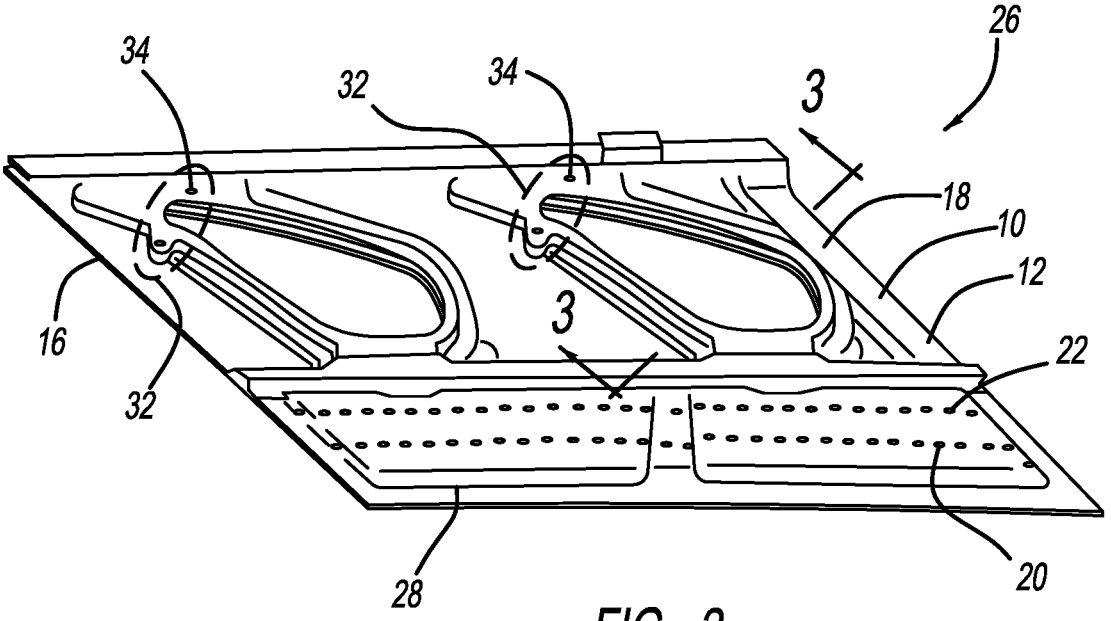
FIG. 2 is a perspective rear view of the cast component depicted in FIG. 1.
Figure 3:
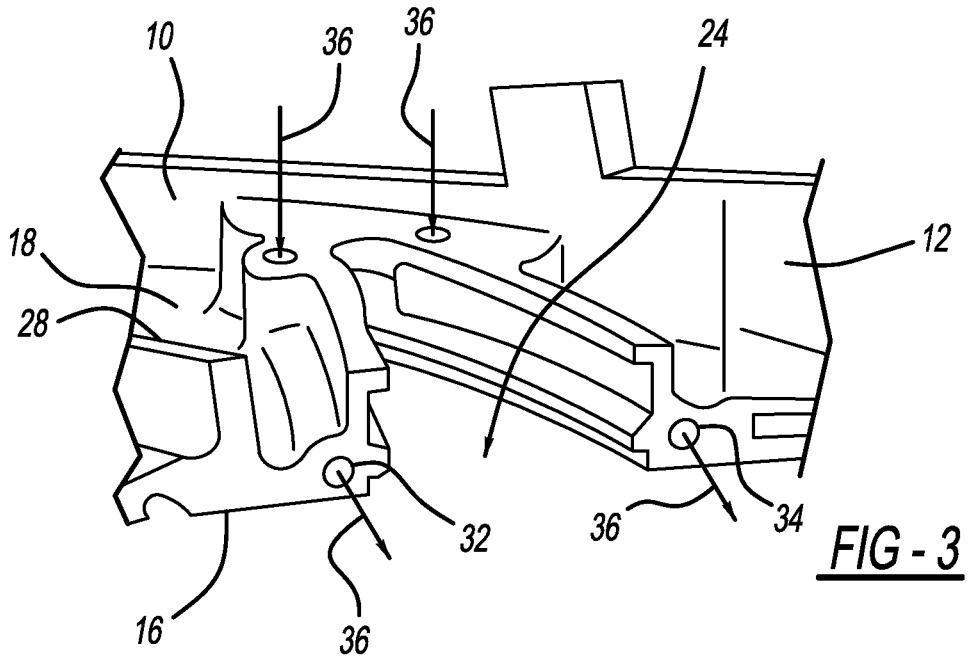
FIG. 3 is a sectional view of the cast component depicted in FIG. 2 along line 3-3.

FIG. 1 is a perspective front view of a cast component 10 in accordance with an exemplary embodiment. FIG. 2 is a perspective rear view of the cast component 10 and FIG. 3 is a sectional view of the cast component 10 depicted in FIG. 2 along line 3-3. As illustrated, the cast component 10 has a cast metal body 12 that defines a platform 14 having outer sides 16 and 18 extending between a forward edge and a rearward edge 19. In an exemplary embodiment, the cast metal body 12 is a single crystal casting of a metal alloy, such as, a nickel based alloy for example a nickel based equiax alloy, a nickel based alloy comprising cobalt or the like, a cobalt based alloy, an iron based alloy, a titanium based alloy, or the like.

The cast component 10 has rows of cooling apertures 20 and 22 extending from the outer side 16 to the outer side 18 substantially transverse to the platform 14 and substantially parallel to and off-set from the forward edge 17. As such, the cooling apertures 20 and 22 are relatively short, linear passageways having a length of about the thickness of the platform 14. In an exemplary embodiment, the cast component 10 has relatively large, tear-shaped openings 24 formed therethrough that are each configured for mounting an additional structure downstream from the cooling apertures 20 and 22. In one embodiment, the cast component 10 is a gas turbine engine component of a gas turbine engine 26, such as, for example, an end wall 28 (e.g., outer or inner end wall) and the tear-shaped openings 24 are each configured for receiving and mounting an airfoil 30, e.g., first stage turbine vane.

Adjacent to the tear-shaped openings 24 are cooling channels 32 and 34. In an exemplary embodiment, the cooling channels 32 and 34 are relatively long and narrow channels that are arranged with open ends just forward of the tear-shaped openings 24 on the outer side 16 and extending therefrom through the platform 14 laterally adjacent to the openings 24 with opposing open ends proximate to the rearward portions of the openings 24 on the outer side 18. As such, this allows cooling air or gases 36 (e.g., compressor by-pass air or gases) to pass through the cooling channels 32 and 34 to remove or redistribute heat along the outer platform surfaces 16 and 18 adjacent to the tear-shaped openings 24.

FIGS. 4-9 illustrate methods for fabricating the cast component 10 illustrated in FIGS. 1-3 in accordance with various embodiments. The described process steps, procedures, and materials are to be considered only as exemplary embodiments designed to illustrate to one of ordinary skill in the art methods for practicing the invention; the invention is not limited to these exemplary embodiments. Various steps in the manufacture of cast components are well known and so, in the interest of brevity, many conventional steps will only be mentioned briefly herein or will be omitted entirely without providing the well-known process details.

Figure 5:
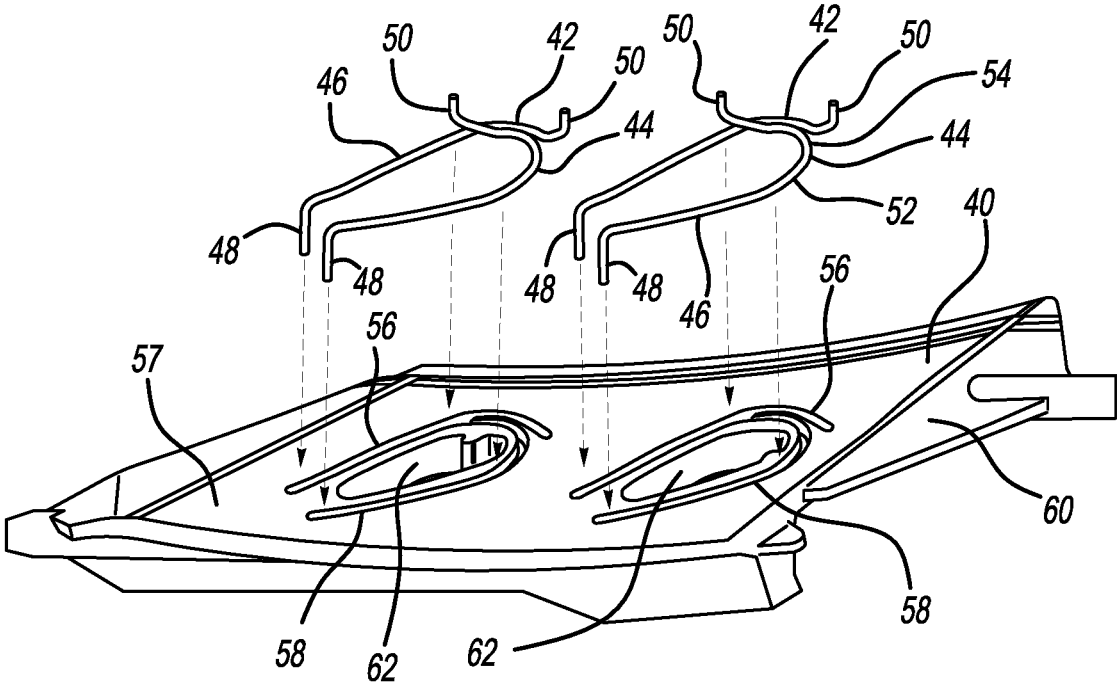
FIG. 5 is a perspective front view of a pattern and a ceramic matrix composite (CMC) elongated core for forming a cast component during an early fabrication stage in accordance with an exemplary embodiment.
Figure 4:
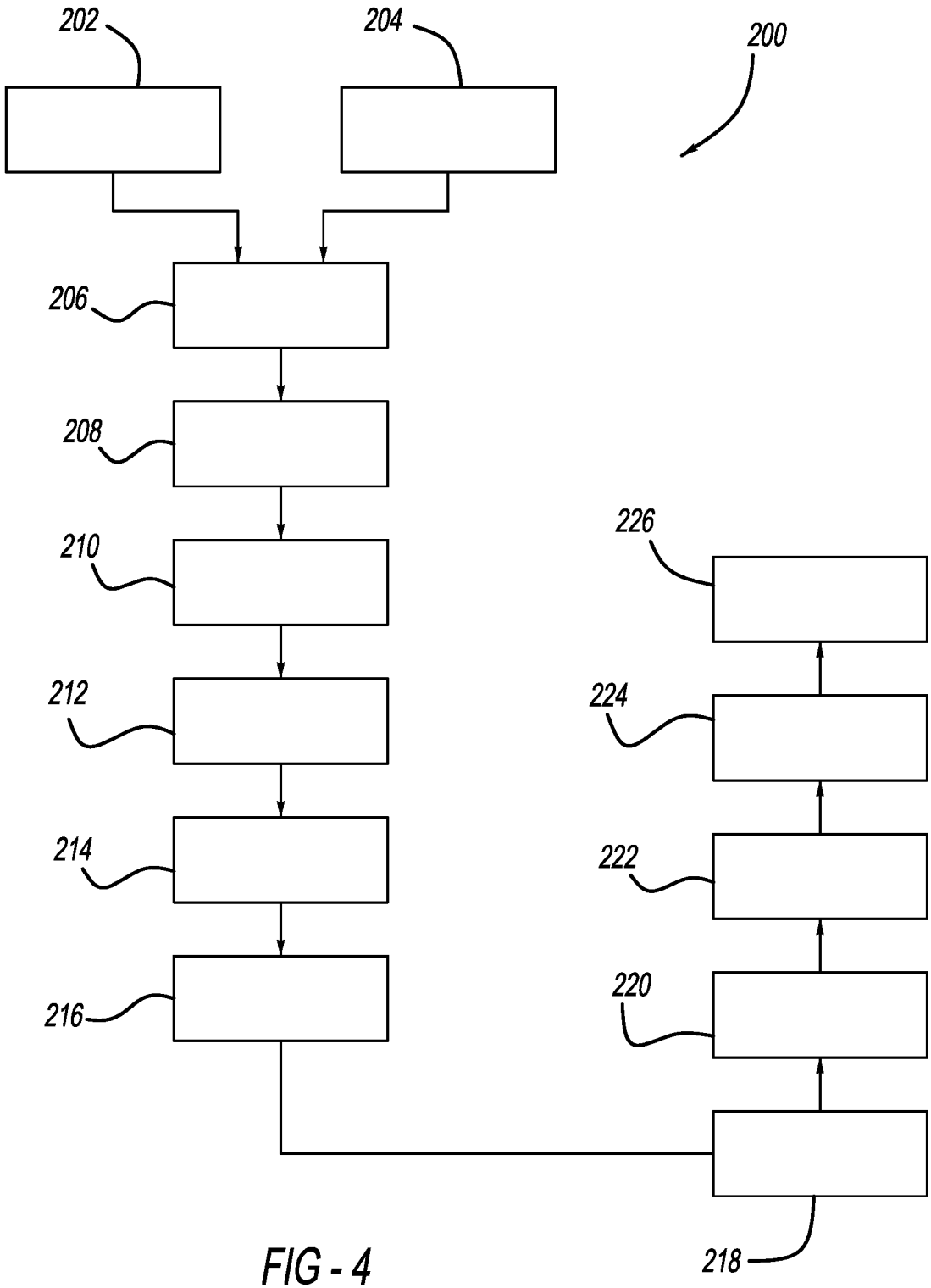
FIG. 4 is a flow chart of a method for fabricating a cast component in accordance with an exemplary embodiment.

FIG. 4 illustrates a flow chart of a method 200 for fabricating the cast component 10 in accordance with an exemplary embodiment. FIG. 5 is a perspective front view of a pattern 40 and ceramic matrix composite (CMC) elongated cores 42 and 44 for forming the cast component 10 (illustrated in FIGS. 1-3) during an early fabrication stage in accordance with an exemplary embodiment. The CMC elongated cores 42 and 44 are provided at step 202. As illustrated, the CMC elongated cores 42 and 44 are configured as relatively long and narrow rods, which may be non-linear and/or partially or substantially tortuous, each having an intermediate section 46 that is disposed between end sections 48 and 50. The end sections 48 and 50 extend from opposite ends of the intermediate section 48 in generally opposing directions that are transverse to the longitudinal direction(s) of the intermediate section 46.

The CMC elongated cores 42 and 44 include a ceramic matrix 52 that is reinforced with ceramic fibers 54. In an exemplary embodiment, the CMC elongated cores 42 and 44 include ceramic fibers present in an amount of from about 15 to about 50 volume percent (vol. %). In an exemplary embodiment, the ceramic fibers include or consist essentially of fibers of alumina, mullite, silicon carbide, silicon nitride zirconia, carbon, or combinations thereof. In an exemplary embodiment, the ceramic matrix includes or consists essentially of silicon metal, silicon metal alloy, silicon carbide, silicon nitride, zirconia, alumina, or combinations thereof.

The CMC elongated cores 42 and 44 may be formed for example by injecting a ceramic slurry that includes a ceramic matrix-forming material and the ceramic fibers into a multi-piece die, solidifying the ceramic slurry, removing the solidified ceramic members from the multi-piece die, and firing or sintering the solidified ceramic members to remove binders and strengthen the ceramic materials to form the elongated cores 42 and 44. Alternatively, the multi-piece die may be preloaded with the ceramic fibers, such as, for example, a ceramic fiber preform and/or continuous strands of ceramic fibers (e.g., unidirectional), and the ceramic matrix-forming material may be injected into the multi-piece die to infiltrate the ceramic fibers with the ceramic matrix-forming material, and then the process continues by solidifying, removing, and firing or sintering to form the CMC elongated cores 42 and 44.

The pattern 40 is provided at step 204. As illustrated, the pattern 40 is similarly configured to the net shape or near net shape of the platform 14 of the cast component 10 illustrated in FIGS. 1-3 with the exception that the pattern 40 includes trenches 56 and 58 that are formed extending into an outer surface 57 of the pattern 14. As illustrated, the pattern 40 has tear-shaped openings 62 that correspond to the tear-shaped openings 24 illustrated in FIGS. 1-3. The trenches 56 and 58 are positioned relative to the tear-shaped openings 62 substantially corresponding to the positioning of the cooling channels 32 and 34 relative to the tear-shaped openings 24 formed in the cast component 10 as illustrated in FIGS. 1-3. In this embodiment, the pattern 40 is absent features that correspond to the cooling apertures 20 and 22 in the cast component 10 (shown in FIGS. 1-3) since the cooling apertures 20 and 22 can be added by a post-machining process after the component 10 is cast due to the relatively short length and linear configuration of the cooling apertures 20 and 22.

In an exemplary embodiment, the pattern 40 is formed of a pattern-forming material 60 such as wax or a plastic material. The patterned 40 may be formed using conventional techniques such as by injecting the pattern-forming material 60, in a molten form, into a multi-piece die, followed by solidifying the pattern-forming material 60 to form the patterned 40, which is subsequently removed from the multi-piece die.

Figure 6:
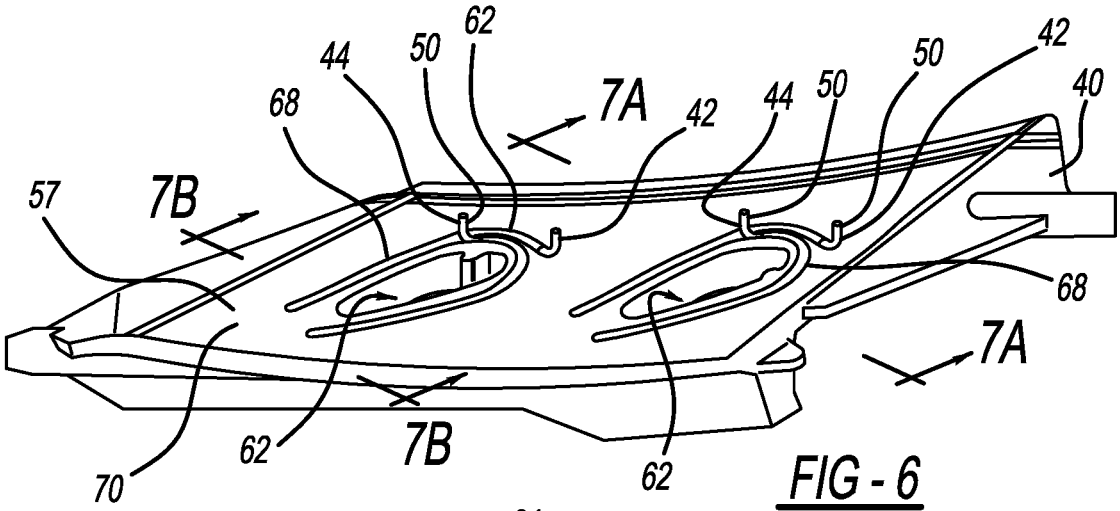
FIG. 6 is a perspective front view of a pattern-CMC elongated core arrangement for forming a cast component during an intermediate fabrication stage in accordance with an exemplary embodiment.
Figure 7A:
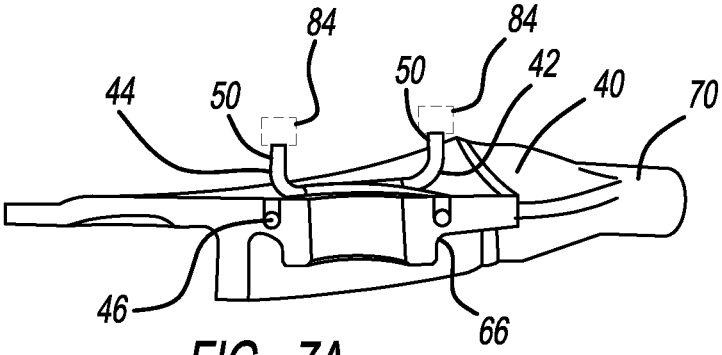
FIGS. 7A-B are sectional views of the pattern-CMC elongated core arrangement depicted in FIG. 6 along lines A-A and B-B, respectively.
Figure 7B:
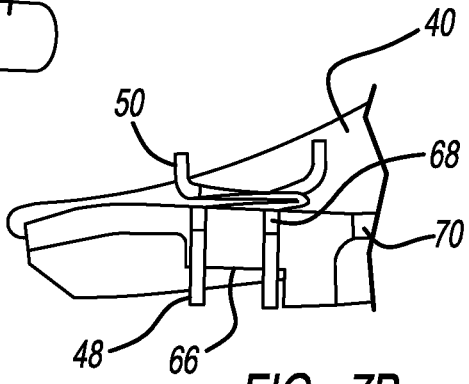
Figure 8:
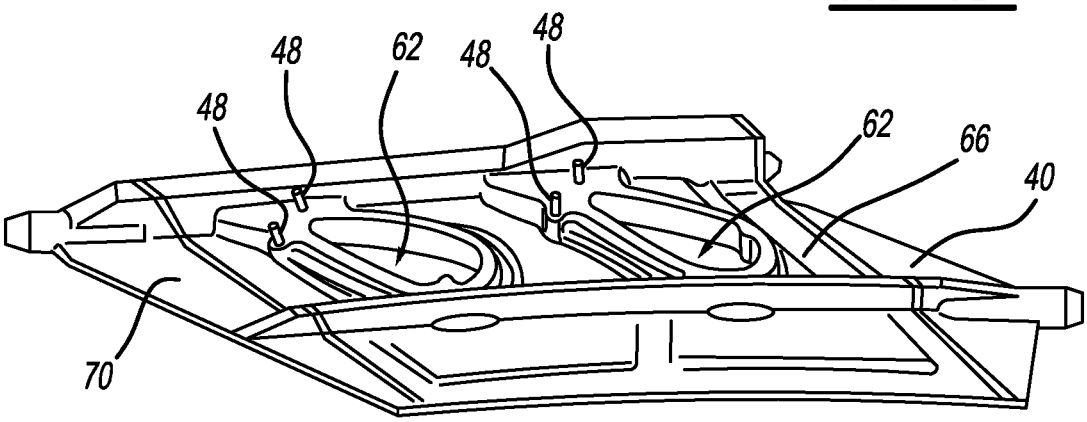
FIG. 8 is a perspective rear view of the pattern-CMC elongated core arrangement depicted in FIG. 6.

Referring also to FIGS. 6-8, the process continues by arranging the CMC elongated cores 42 and 44 in the pattern 40 at step 206. As illustrated, the CMC elongated cores 42 and 44 are positioned such that the intermediate sections 46 of the CMC elongated cores 42 and 44 are arranged in the trenches 56 and 58 extending generally parallel to and/or offset from the outer surface 57 of the pattern 40. The end sections 48 and 50 of the CMC elongated cores 42 and 44 extend in generally opposing directions transverse to the outer surface 57 of the pattern 40 such that the end sections 48 protrude outwardly from the outer surface 66 of the pattern 40 and the end sections 50 protrude outwardly from the outer surface 57 of the pattern 40. Additionally, the intermediate sections 46 of the CMC elongated cores 42 and 44 are arranged laterally adjacent to their neighboring openings 62.

In one embodiment, the patterned 40 is formed using a rapid prototype method, e.g., 3-D printing, to form the pattern 40 with open trenches. In an alternative embodiment, the patterned 40 may be formed in a die (e.g., hard tooling) that supports the CMC elongated cores 42 and 44 in the die. The pattern-forming material (e.g., wax) is then injected into the die to fill the die so as to produce the pattern 40 with the CMC elongated cores 42 and 44 already arranged in the pattern 40.

The process continues by filling the remaining spaces in the trenches 56 and 58 with additional pattern-forming material 68 at step 208 to define a pattern-CMC elongated core arrangement 70. In particular, the remaining spaces in the trenches 56 and 58 between the CMC elongated cores 42 and 44 and the sidewalls of the pattern 40 that define the trenches 56 and 58 are filled with the additional pattern-forming material 68. In an exemplary embodiment, the additional pattern-forming material 68 is wax that is formed into the remaining spaces in the trenches 56 and 58 using a manual process or an automated process. In the alternative embodiment in which the pattern 40 is formed with the CMC elongated cores 42 and 44 already arranged therein, the process flows from steps 204 to 210 without steps 206 and 208.

Figure 9:
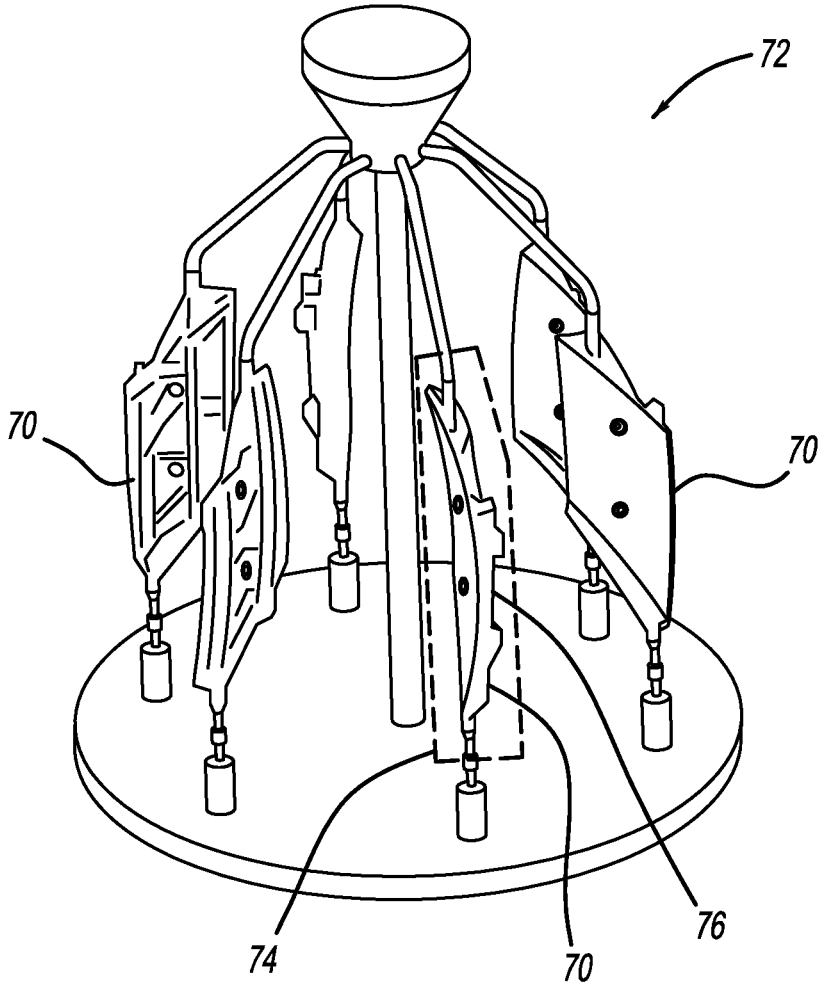
FIG. 9 is an arrangement of shell molds for forming a cast component during a later fabrication stage in accordance with an exemplary embodiment.

Referring also to FIG. 9, the process continues by assembling multiple pattern-CMC elongated core arrangements 70 into a conventional investment cast tree arrangement at step 210. In an exemplary embodiment, using an investment cast process, shell molds 74 are formed over the pattern-CMC elongated core arrangements 70 to define a cavity 76 in each of the shell molds 74 at step 212. In one example, the shell molds 74 are formed by dipping the tree arrangement 72 in a ceramic slurry multiple times to build layers of the ceramic slurry material onto the pattern-CMC elongated core arrangements 70 and then allowing the ceramic slurry material to dry. As discussed above, the end sections 48 and 50 of the CMC elongated cores 42 and 44 protrude from the pattern(s) 40 and as such, the end sections 48 and 50 will be at least partially disposed in the walls of the shell molds 74 to help support the CMC elongated cores 42 and 44 in the cavities 76.

The process continues by replacing the pattern-forming material(s) 60 and 68 with metal via the investment casting process to form the cast component 10 (see FIGS. 1-3) with the CMC elongated cores 42 and 44 disposed therein defining the cooling channels 32 and 34. In particular, the pattern-forming material(s) 60 and 68 is removed from the shell molds 74 at step 214. In one example, the pattern-forming material(s) 60 and 68 is removed from the shell molds 74 by melting out, washing out, and/or burning the pattern-forming material (s) 60 and 68 (e.g., wax) from the shell molds 74. Once the plastic-forming material(s) 60 and 68 is removed, the cavities 76 of the shell molds are substantially empty with the exception that the CMC elongated cores 42 and 44 are disposed in the open volume of the cavities 76 with the end sections 48 and 50 supportingly disposed in the walls of the shell molds 74. The shell molds 74 may then be baked, fired, and/or sintered at step 216 to increase the strength of the shell molds 74.

In an exemplary embodiment, the investment casting process is a single crystal casting process and the process continues by providing a seed crystal to each of the cavities 76 of the shell molds 74 at step 218. The shell molds 74 are then preheated to a predetermined temperature at step 220. In one embodiment, the shell molds 74 are preheated to a temperature of from about 1350 to about 1550° C.

Next, the cavities 76 of the preheated shell molds 74 are filled with molten metal and the molten metal is solidified to form the cast components 10 (see FIGS. 1-3) at step 222. In an exemplary embodiment, the molten metal is a nickel base alloy, a nickel base alloy comprising cobalt, a cobalt base alloy, or the like and has a temperature of from about 1300 to about 1650° C. The molten metal is solidified by cooling the molten metal at a relatively slow cooling rate to form a single crystal cast component as is well known to those skilled in the art. The cast components 10 are removing from the shell molds at step 224, for example, by breaking loose the shells of the shell molds 74 off of the cast components 10, cutting off the gates and grit blasting the cast components 10.

The process continues by removing the CMC elongated cores 40 and 42 from the cast components 10 at step 226. In an exemplary embodiment, the CMC elongated cores 40 and 42 are removed by leaching out or etching the CMC elongated cores 40 and 42 using a wet etching process to open the cooling channels 32 and 34 in the cast components 10 for fluid communication. In one example, the wet etching process includes a caustic material such as potassium hydroxide for removing the CMC elongated cores 40 and 42.

Figure 10:
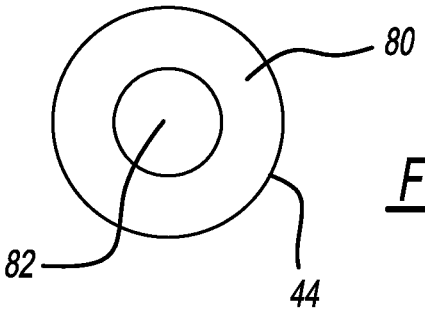
FIG. 10 is a cross-sectional view of a CMC elongated core in accordance with an exemplary embodiment.

Referring to FIG. 10, a cross-sectional view of a CMC elongated core 44 in accordance with an alternative embodiment is provided. In particular and as illustrated, the CMC elongated core 44 instead of being a solid elongated core as illustrated in FIGS. 5 and 6-8, the CMC elongated core 44 is a tubular elongated core having a wall 80 that surrounds a hollow passageway 82. In this embodiment, the tubular shape with the hollow passageway 82 facilitates removing the CMC elongated core 44 during the step of leaching out and/or etching. In particular, prior to forming the shell mold over the pattern-CMC elongated core arrangement 70, the ends of the CMC elongated core 44 are closed off with caps 84 and then the shell mold is formed. After casting the cast component 10, the caps 84 may be removed to allow a wet etchant, for example, to flow into the hollow passage 82 to facilitate or improve (e.g., increase) the etching rate and removal of the CMC elongated core 44. It is to be understood that in the various embodiments and process steps disclosed herein, the CMC elongated core(s) can be solid or tubular and hollow depending upon the specific design and/or process conditions being used to form the cast component 10.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments have been described, it will be apparent to those of ordinary skill in the art that many more embodiments and implementations are possible. Accordingly, the embodiments described herein are examples, not the only possible embodiments and implementations. Furthermore, the advantages described above are not necessarily the only advantages, and it is not necessarily expected that all of the described advantages will be achieved with every embodiment.

What is claimed is:

1. A method for fabricating a cast component having a cooling channel formed therein, the method comprising:

forming a shell mold over a pattern-ceramic matrix composite (CMC) elongated core arrangement to define a cavity in the shell mold, wherein the pattern-CMC elongated core arrangement comprises a pattern-forming material with a CMC elongated core disposed therein, the CMC elongated core being a monolithic tubular structure with a hollow passage formed therethrough and comprising a ceramic matrix reinforced with ceramic fibers, the ceramic fibers being present in an amount of from about 15 to about 50 volume percent (vol. %) of the CMC elongated core;

replacing the pattern-forming material in the cavity with metal via a casting process to form the cast component with the CMC elongated core disposed therein defining the cooling channel; and removing the CMC elongated core from the cast component to open the cooling channel for fluid communication, wherein the removing comprises advancing a wet etchant into the hollow passage to facilitate leaching out and/or etching of the CMC elongated core.

2. The method of claim 1, further comprising forming the pattern-CMC elongated core arrangement comprising:

providing a pattern comprising the pattern-forming material and having a trench formed in the pattern-forming material; and disposing the CMC elongated core in the trench.

3. The method of claim 2, wherein the pattern has walls that define the trench, and wherein forming the pattern-CMC elongated core arrangement comprises filling remaining space in the trench between the CMC elongated core and the walls of the pattern with additional pattern-forming material.

4. The method of claim 3, wherein the additional pattern-forming material is wax.

5. The method of claim 2, wherein the CMC elongated core has an intermediate section, and wherein disposing the CMC elongated core in the trench comprises arranging the intermediate section of the CMC elongated core in the trench extending parallel to and/or offset from an adjacent outer surface of the pattern.

6. The method of claim 5, wherein the CMC elongated core has a first end section and a second end section extending from opposing ends of the intermediate section, and wherein disposing the CMC elongated core in the trench comprises arranging the first and second end sections extending in generally opposing directions transverse to the adjacent outer surface of the pattern.

7. The method of claim 6, wherein disposing the CMC elongated core in the trench comprises arranging the first end section protruding from the adjacent outer surface of the pattern and the second end section protruding from an opposing outer surface of the pattern that is arranged on a side opposite the adjacent outer surface.

8. The method of claim 7, wherein forming the shell mold comprises forming the shell mold such that the first and second end sections are at least partially disposed in walls of the shell mold.

9. The method of claim 7, wherein the pattern has an opening formed therethrough extending from the adjacent outer surface to the opposing outer surface, and wherein disposing the CMC elongated core comprises arranging the intermediate section of the CMC elongated core in the trench adjacent to the opening.

10. The method of claim 1, wherein removing the CMC elongated core comprises leaching out or etching the CMC elongated core using a wet etching process.

11. The method of claim 1, wherein fabricating the cast component comprises forming the cast component as a gas turbine engine component.

12. The method of claim 1, wherein the pattern-forming material comprises wax or plastic material.

13. The method of claim 1, further comprising forming the pattern-CMC elongated core arrangement comprising disposing the CMC elongated core in a pattern that comprises the pattern-forming material, wherein disposing the CMC elongated core in the pattern includes:

providing the CMC elongated core; and forming and/or injecting the pattern over the CMC elongated core.

14. The method of claim 1, wherein the method further comprises:

forming caps over ends of the CMC elongated core prior to forming the shell mold to close off the hollow passage; and removing the caps from the ends of the CMC elongated core after forming the cast component to open the hollow passage.

15. The method of claim 1, wherein the ceramic matrix comprises silicon carbide and the ceramic fibers comprise silicon carbide.

16. A method for fabricating a cast component having a cooling channel formed therein, the method comprising:

disposing a ceramic matrix composite (CMC) elongated core in a pattern that comprises a pattern-forming material, wherein the CMC elongated core is a monolithic tubular structure with a hollow passage formed therethrough and comprises a ceramic matrix reinforced with ceramic fibers, the ceramic fibers being present in an amount of from about 15 to about 50 volume percent (vol. %) of the CMC elongated core;

forming a shell mold over the pattern-CMC elongated core arrangement to define a cavity in the shell mold;

removing the pattern-forming material from the shell mold while leaving the CMC elongated core disposed in the cavity;

filling the cavity with molten metal and solidifying the molten metal to form the cast component with the CMC elongated core disposed therein defining the cooling channel; and leaching out or etching the CMC elongated core to open the cooling channel in the cast component for fluid communication, wherein caps are formed over ends of the CMC elongated core prior to forming the shell mold to close off the hollow passage, wherein the caps are removed from the ends of the CMC elongated core after forming the cast component to open the hollow passage, and wherein the leaching out or etching comprises advancing a wet etchant into the hollow passage to facilitate the leaching out or etching of the CMC elongated core.

17. The method of claim 16, wherein disposing the CMC elongated core in the pattern comprises providing the CMC elongated core comprising ceramic fibers of alumina, mullite, silicon carbide, silicon nitride, zirconia, carbon, or combinations thereof.

18. The method of claim 16, wherein disposing the CMC elongated core in the pattern comprises providing the CMC elongated core comprising the ceramic matrix that comprises silicon metal, silicon metal alloy, silicon carbide, silicon nitride, zirconia, alumina, or combinations thereof.

19. The method of claim 16, wherein filling the cavity with molten metal and solidifying the molten metal comprises forming the cast component using a single crystal casting process.

20. The method of claim 19, wherein forming the cast component comprises preheating the shell mold to a temperature of from about 1350 to about 1550° C. prior to filling the cavity with the molten metal.

21. The method of claim 16, wherein the ceramic matrix comprises silicon carbide and the ceramic fibers comprise silicon carbide.

* * * * *